US005649843A

United States Patent [19]

Elger

[11] Patent Number: 5,649,843

[45] Date of Patent: Jul. 22, 1997

[54] WATERJET PROPULSION UNIT FOR WATER CRAFT WITH CONTROL ELEMENTS FOR CHANGING THE DIRECTION OF THRUST OF THE WATERJET

[76] Inventor: Gerd Elger, Neftenbacher Strasse 26, CH-8408 Winterthur, Switzerland

[21] Appl. No.: 525,685

[22] PCT Filed: Jan. 24, 1995

[86] PCT No.: PCT/DE95/00099

§ 371 Date: Nov. 20, 1995

§ 102(e) Date: Nov. 20, 1995

[87] PCT Pub. No.: WO95/20520

PCT Pub. Date: Aug. 3, 1995

[30] Foreign Application Priority Data

Jan. 28, 1994 [DE] Germany ..... 44 02 558.0

[51] Int. Cl.[6] ..... B63H 11/00

[52] U.S. Cl. ..... 440/38; 440/47

[58] Field of Search ..... 114/150, 151; 440/38, 40–42, 47, 67; 60/221, 222

[56] References Cited

U.S. PATENT DOCUMENTS

| | | | |
|---|---|---|---|
| 3,249,083 | 5/1966 | Irgens . | |
| 3,593,686 | 7/1971 | Cooper | 114/151 |
| 3,605,672 | 9/1971 | Strumbos . | |
| 4,992,065 | 2/1991 | Torneman et al. . | |

FOREIGN PATENT DOCUMENTS

| | | | |
|---|---|---|---|
| 722842 | 7/1942 | Germany . | |
| 2644743 | 4/1978 | Germany . | |
| 3735409 | 5/1989 | Germany | 440/67 |
| 0060392 | 3/1986 | Japan | 114/151 |
| 0262290 | 10/1989 | Japan | 440/47 |
| 1149136 | 10/1967 | United Kingdom | 440/67 |
| 11452237 | 3/1969 | United Kingdom . | |
| 1190735 | 5/1970 | United Kingdom . | |

OTHER PUBLICATIONS

Article From Yacht Authored by Von Joachim F. Muhs Entitled "Schub Im Bug," Published on Aug. 11, 1993, pp. 28–31.

Patent Abstracts of Japan, vol. 14, No. 355 Published on Jul. 31, 1990 For JPA 02 124395.

International Publication WO 84/01759 and Corresponding Search Report Published Under the Patent Cooperation Treaty on May 10, 1984.

*Primary Examiner*—Edwin L. Swinehart

*Attorney, Agent, or Firm*—McAulay Fisher Nissen Goldberg & Kiel, LLP

[57] ABSTRACT

Water jet propulsion unit for watercraft having a pump and stators arranged upstream and downstream of the pump for eliminating turbulence in the entering water and in the water jet generated by the pump, having coaxially arranged nozzles which are associated with the respective stator and are supported so as to be displaceable axially independently of one another, and having a switchable gear unit for driving the pump in the clockwise or counterclockwise direction in order to change the direction of motion of the watercraft, the water jet propulsion unit being supported at the watercraft so as to be swivelable by ±90° approximately vertically to the axis of rotation of the pump rotor.

6 Claims, 3 Drawing Sheets

WATERJET PROPULSION UNIT FOR WATER CRAFT WITH CONTROL ELEMENTS FOR CHANGING THE DIRECTION OF THRUST OF THE WATERJET

BACKGROUND OF THE INVENTION a) Field of the Invention

The invention is directed to a water jet propulsion unit for watercraft with a pump and a stator and a nozzle for generating a propulsive water jet and with control elements for changing the direction of the water jet.

b) Description of Related Art

There are many known examples of water jet propulsion units for watercraft in which the water which is sucked in via a pump and accelerated exits as a directed jet via a nozzle which influences its direction, turbulence being eliminated in the water jet via a stator.

For example, U.S. Pat. No. 4,992,065 shows a water jet propulsion unit having a nozzle which is arranged downstream of the stator and supported so as to swivelable about a vertical axis. The outlet opening of the nozzle can be changed via flaps which are swivelable about an axis oriented horizontally thereto until the direction of the water jet is reversed for the purpose of controlled movement in reverse.

A construction of this kind is extremely costly due to the control elements, poses considerable sealing problems for the accelerated water jet, and causes a substantial cross-sectional portion of the water jet to be cut off, in particular when deflecting angles are large. As a result of these deflection losses, the reverse thrust is reduced in such a way that maneuvering problems occur especially through passes having currents and in narrow harbors. Further, a corresponding steering effect must be allowed for; otherwise, a reversing of the directional effect takes place when changing from forward to reverse motion which further complicates the control elements and leads to errors.

Simpler constructions, e.g., in the form of two flaps which are arranged downstream of the outlet opening and are swivelable respectively about vertical axes (see GB 1 190 735), result in a totally unsatisfactory steering effect of the water jet propulsion unit when stopped and at slow speed.

To prevent flow losses it is also known to construct the nozzle serving as a control from concentrically supported spherical surfaces. This is also costly and requires complicated controlling and sealing elements—see DE 26 44 743 A1.

For the above reasons, there is a substantial need for improvement of such water jet propulsion units for the controlled forward and reversing motion of a watercraft of whatever kind.

OBJECT AND SUMMARY OF THE INVENTION

Proceeding from the known shrouded ship propellers, so-called bow thrusters, which enable steering with the stem or stern post of a watercraft—see YACHT 17/1993, pages 28 to 30—the object of the present invention is to provide an improved water jet propulsion unit whose controlling elements are constructed in a simpler manner than is conventional and which enable a watercraft outfitted with a water jet propulsion unit of this kind to be controlled more effectively than was previously possible.

This object is met according to the invention in that the controlling elements comprise at least one nozzle which is supported so as to be displaceable axially between a maximum open position and a minimum open position, a gear unit enabling the rotor of the pump to be driven in both the clockwise and counterclockwise directions, and a pivot bearing which enables the housing supporting the nozzle and pump to execute swiveling movements of at least ±90° vertically to the axis of rotation of the pump.

According to a first embodiment form of the invention, nozzles arranged in a mirror-inverted and identical manner are associated with the pump upstream and downstream, respectively, both nozzles being supported so as to be displaceable axially independently from one another in such a way that when one nozzle is positioned, for instance, in the axial open position, the other nozzle is displaceable in the direction of the minimum open position and vice versa.

According to another feature of the invention, the rotor of the pump can be driven in the clockwise direction as well as in the counterclockwise direction via a distributor gear unit which is constructed as a universal gear and whose gear branches can be activated via a sliding coupling, the drive shaft of the distributor gear unit forming the swivel axis of the water jet propulsion unit, which swivel axis is oriented approximately vertically to the axis of rotation of the rotor.

According to another feature of the invention, each of the axially displaceable nozzles forms a conical outer surface area whose angle of slope corresponds to the slope of the free ends of the blades of the stator facing it, and the housing of the pump supporting the respective stator widens radially outward in the region of the free ends of the blades of the respective stator in order to form an roughly annular or elliptical channel between the nozzle and the housing wall.

According to a preferred embodiment form of the invention, the transmission of power between the distributor gear unit and the rotor is effected via internal geared wheels or ring gears which are arranged in the stators—see DE 42 41 724 A1.

According to a second embodiment form of the invention, only one axially displaceable nozzle is associated with the pump and the axes of the pump and stator enclose an angle β, this arrangement being effected in such a way that when changing the rotating direction of the rotor of the pump to reverse direction from forward to reverse, the inlet of the water jet propulsion unit can be used as an outlet nozzle while the nozzle with its roughly annular or elliptical channel serves as an inlet.

The construction of the water jet propulsion unit according to the invention has a number of advantages.

Similar to the known bow thrusters, the water jet propulsion unit according to the invention acts as an active rudder since it can be used to move forward as well as backward depending on the rotating direction of the rotor of the pump, the paddle blades of the rotor being designed in such a way that they have the greatest efficiency for the forward motion of the watercraft as is described and shown for example in GB 1 145 237 for bow thrust rudders.

The volume of water supplied to the stator acting as a guiding mechanism or control device is regulated on the inlet side via the nozzle arranged downstream, while the nozzle on the delivery side or pressure side, that is, the upstream nozzle, is displaced in the direction of the rotor as the speed of the watercraft increases so that the effect of the roughly annular or elliptical channel operating as an additional nozzle is progressively eliminated until, at cruising speed, only the nozzle located on the pressure side functions as a thrust nozzle.

Since there is only one axially displaceable nozzle in the second embodiment form of the invention, the inlet acts as the thrust nozzle when moving in reverse after the turbulence has been removed from the jet by means of the stator, wherein the full benefit of the water jet propulsion unit acting as an active rudder is likewise obtained in this case.

The construction of the water jet propulsion unit according to the invention is suited equally well for all power units and the symmetrical construction of the axially displaceable nozzles and associated stators enables an inexpensive manufacture and simple assembly and maintenance. Due to the regulation of water volume which is made possible by the stators cooperating with the axially displaceable nozzles, an optimum quiet running is achieved with minimum fuel consumption in the simplest manner for forward and reverse motion as well as for maneuvering. The volume of water required for static thrust, acceleration, slow speed and cruising speed can be regulated in the simplest manner. Thus the water jet propulsion unit according to the invention can be used equally well as a main propulsion unit with active rudder and stern thrust rudder or as an auxiliary propulsion unit.

Due to the use of the roughly annular or elliptical channel as an additional nozzle on the respective pressure side, the cross section is opened for a large volume of water when starting the watercraft, while the flow through the roughly annular or elliptical channel is progressively reduced when picking up speed due to the reduction in water entering through the additional nozzle—as a result of the displacement of the nozzle—until, at cruising speed, the flow is effected exclusively through the nozzle which is optimized in a corresponding manner for this operating range.

Since the entire propulsion unit is swivelably supported in the bottom of the watercraft to be driven, this swiveling being enabled by a toothed belt or a vertical shaft, a completely continuous steering course is possible when changing the rotating direction of the rotor and simultaneously displacing the nozzles from forward motion to reverse motion. The volume of water supplied to the rotor is regulated by means of the displaceable nozzle on the inlet side, that is, the downstream nozzle, which is associated with the stator on the inlet side and acts as a control device. On the other hand, as was already mentioned, by displacing the nozzle on the pressure side, the supply of pumped water to the roughly annular or elliptical channel is controlled in such a way that the volume of water supplied is optimized in the starting range as well as at slow speed so that desired speeds can be reached quickly.

As a result of the inventive construction of the nozzles and associated stators, a further advantage consists in that the nozzles are, on the pressure side, neatly guided on the conically constructed stator blades and positioned concentrically in their maximum working position and are accordingly held in an advantageous manner with respect to flow. The simple symmetrical construction of the propulsion unit provides for uniform thrust in the forward and reverse direction and/or laterally regardless of the traveling direction.

The water jet propulsion unit according to the invention can be used equally well in large ships, large yachts and sailboats. In sailboats, the propulsion unit must be constructed so as to be retractable in the hull of the boat so that it can be drawn in when traveling under sail. In this case, of course, the portion of the bottom of the boat covering the propulsion unit must have a movable design, known per se, in order to obtain a smooth underwater hull for sailing.

Another advantage of the construction of the water jet propulsion unit according to the invention consists in that semiaxial pumps can be used in high-speed hydroplanes and racing yachts owing to the variable speeds in the latter. It is also especially important that the nozzle arrangement of the water jet propulsion-unit according to the invention acts in a manner similar to an adjusting nozzle, specifically without any flap mechanism, by means of the axial adjustment of the nozzle and accordingly partial admission of water to the roughly annular or elliptical channel acting as additional nozzle with the respective required water volume or water flow rates for fast acceleration when starting, for lifting out of the water, during transition to hydroplaning, and when reaching maximum speed.

Another advantage of the construction of the water jet propulsion unit according to the invention consists in that it requires the shortest possible switching times for switching from port to starboard control when used as a bow thrust rudder, since non-turbulent water is supplied to the rotor along the shortest possible path via the roughly annular or elliptical channel. Thus an effective propulsive jet can be generated immediately without first delaying the entire water volume at zero and then accelerating to maximum thrust.

Owing to the symmetrical construction of the nozzles and control devices which act on the pressure side as well as on the suction side, the parts serving for the transmission of power can easily be designed so as to be compact and supported in a twofold manner and assembly is rendered extremely simple in that, once the movable parts which run on bushings inserted in the stators have been attached or moved in, only the housing parts forming the housing need be connected, so that a simple and robust design of all parts and an automated manufacture and easy replacement of these parts is ensured.

The invention is described in the following with reference to two embodiment examples which are shown more or less schematically in the drawing.

DESCRIPTION OF THE PREFERRED EMBODIMENTS

Figure 1:
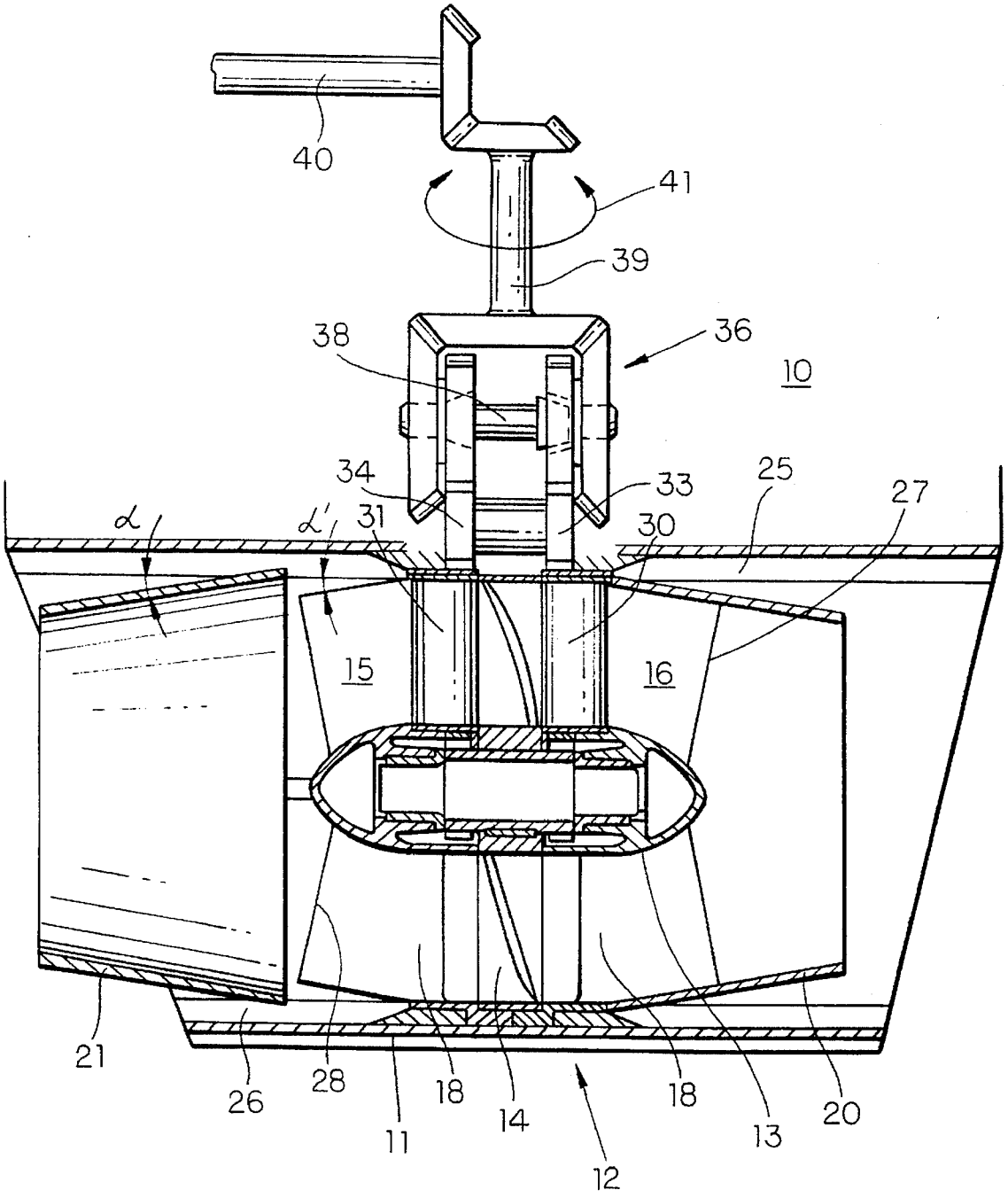
FIG. 1 shows a section through a first embodiment form of a water jet propulsion unit according to the invention in the "forward motion" working position.
Figure 2:
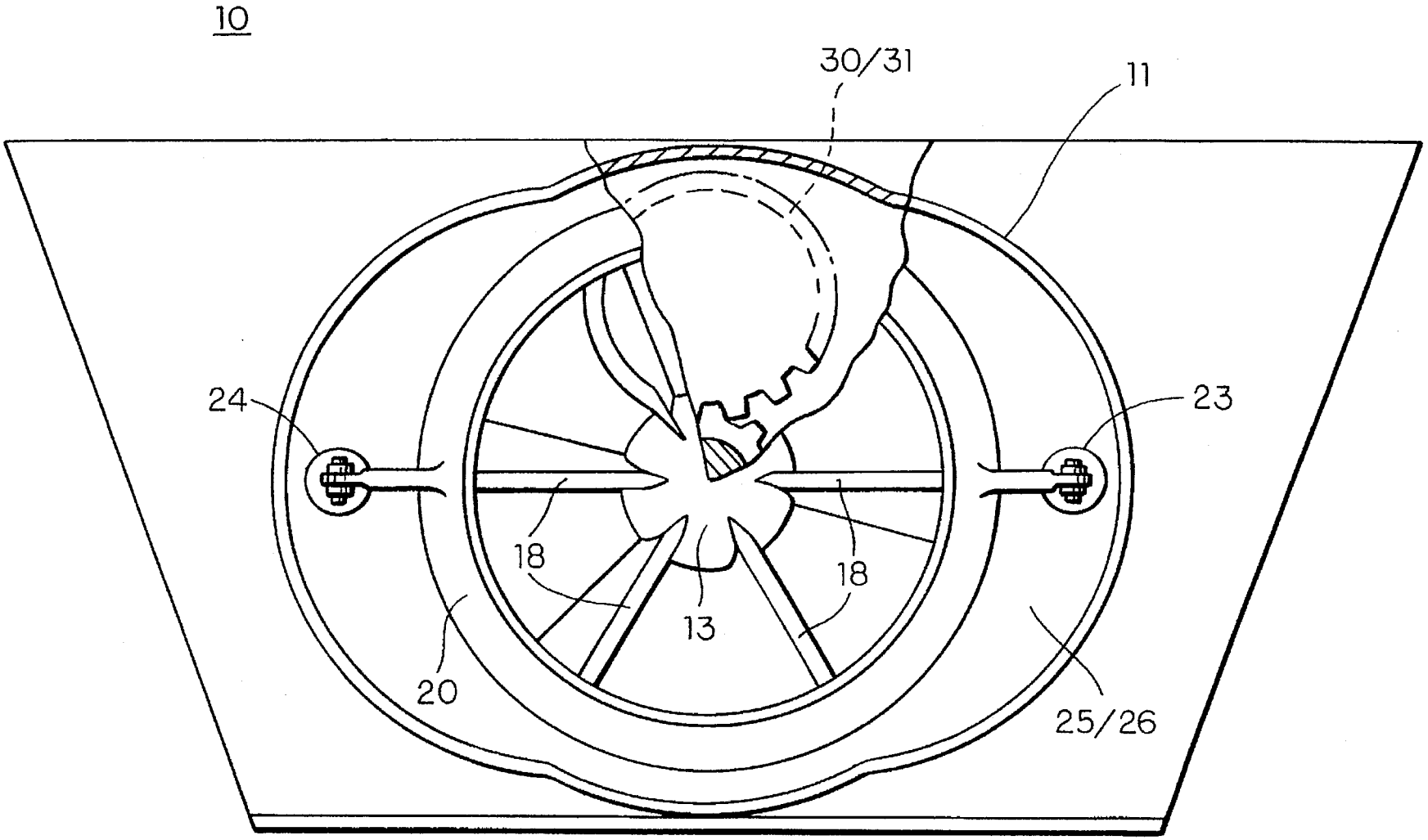
FIG. 2 shows a partially sectioned from view of the water jet propulsion unit according to FIG. 1.
Figure 3:
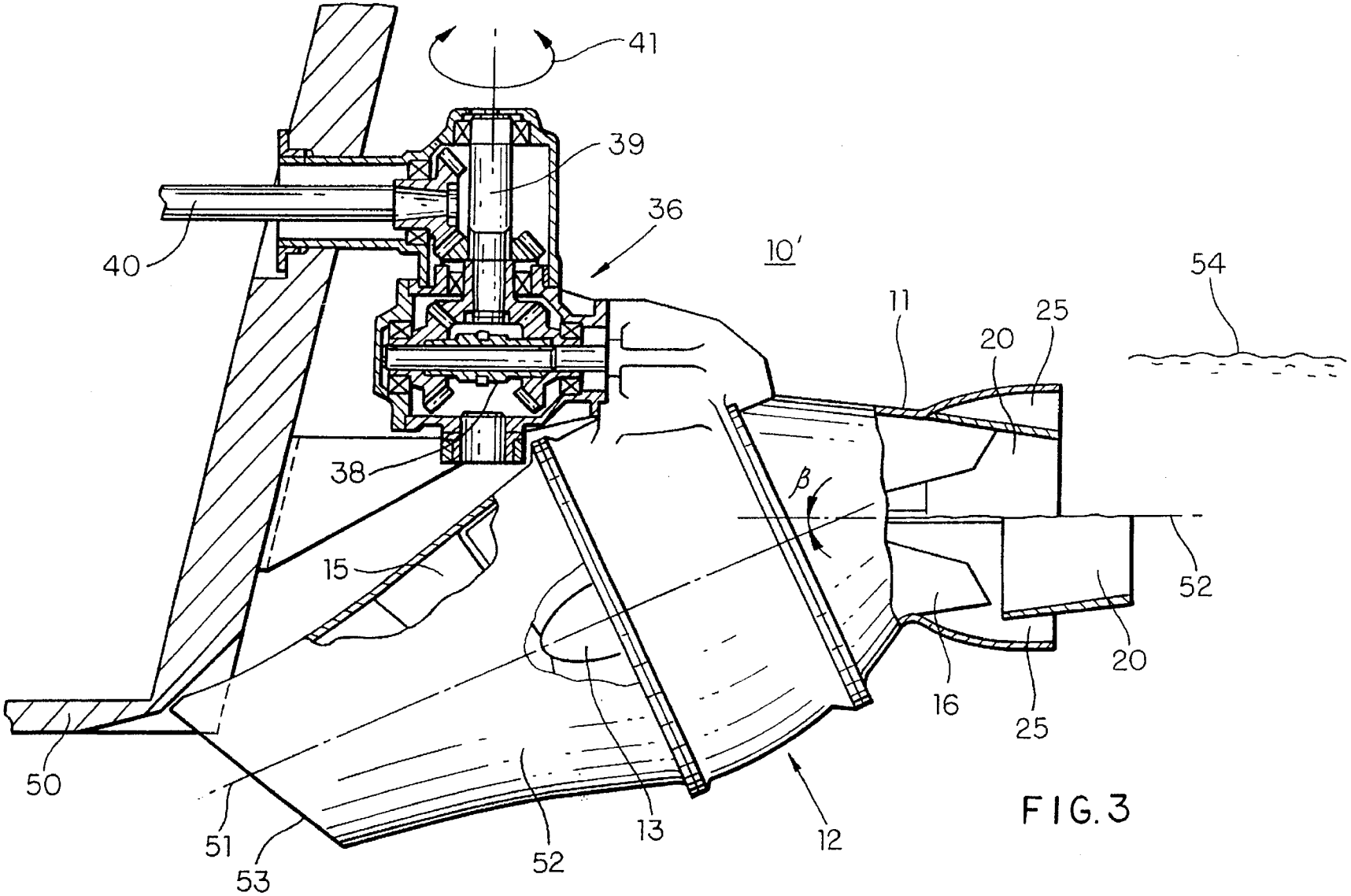
FIG. 3 shows a partially sectioned side view of a second embodiment form of a water jet propulsion unit according to the invention with only one nozzle which is supported so as to be axially displaceable.

A water jet propulsion unit which is designated in general by reference number 10 in FIGS. 1 to 3 comprises, within a housing 11, a pump 12 with a rotor 14 which is rotatably supported in a hub 13. A stator 15 is arranged respectively upstream and downstream of the rotor 14, its correspondingly curved stator blades 18 forming the rigid connection between the housing 11 and the hub 13 as is shown especially in FIG. 2.

The water jet propulsion unit according to the embodiment form shown in FIGS. 1 and 2 further comprises nozzles 20 and 21 which are constructed in each instance with a conical outer surface area and supported at the housing 11 so as to be displaceable axially from a minimum open position to a maximum open position by means of hydraulic cylinders 23 and 24 which are arranged in pairs between the housing and nozzle (see FIG. 2).

The angle of slope α of the conical outer surface areas of the nozzles 20 and 21 is selected in such a way that the latter agree with the angle of slope α' of the outer edges of the free ends 27 and 28 of the stator blades 18 of stators 15 and 16 (see FIG. 1). On the righthand side of FIG. 1, the nozzle 20 is shown in its minimum open position in which roughly half of the inner surface area of the nozzle 20 is supported on the control device so that it is positioned concentrically and held in a manner benefitting flow. On the other hand, nozzle 21 —left-hand side of FIG. 1—is shown in its maximum open position in which the stator is entirely free of the nozzle. This position corresponds to the view shown in FIG. 2.

Since the housing 11 widens radially outward in the regions of the side remote of the rotor 14, as is shown in particular in FIGS. 2 and 3, an additional roughly annular or elliptical channel 25 and 26 is formed in this region, that is, between the outer wall of the housing 11 and the outer surface area of the respective nozzle 20 and 21. Depending on the working position, this roughly annular or elliptical channel serves, on the pressure side, as an additional nozzle for accelerating from a stationary state and, on the suction side, as a changeable inlet of the water jet propulsion unit.

As is shown especially in FIG. 2, so-called ring gears 30 and 31 which are supported in the stators serve to drive the rotor 4, these ring gears 30 and 31 being alternately drivable by means of intermediate gears 33 and 34 via a distributor gear unit 36 constructed as a universal gear. For this purpose, a sliding coupling 38 alternately switches the right and left branch of the distributor gear unit at a vertical shaft drive 39 which is in a drive connection via a drive shaft with a driving motor (not shown) of the watercraft (not shown). The rotor 14 is driven via the ring gear 30 or 31 in the clockwise or counterclockwise direction depending on the switching position of the sliding coupling 38. The blades of the rotor 14 are so designed that they have the greatest efficiency for forward movement of the watercraft.

The water jet propulsion unit described above is supported at the watercraft, not shown, in a manner known per se so as to be swivelable by ±90° in the direction of the double arrow 41 around the vertical shaft 39 forming a pivot bearing for the water jet propulsion unit.

The other embodiment example of the water jet propulsion unit 10' shown in FIG. 3 likewise has a pump with a rotor 14 which is rotatably supported on a hub 13. Two stators 15 and 16 which are held by the housing 11 are likewise arranged upstream and downstream of the rotor, their correspondingly curved stator blades 18 forming the rigid connection between the housing 11 and the hub 13.

In contrast to the embodiment example according to FIGS. 1 and 2, only one nozzle 20 which is supported so as to be axially displaceable is provided in this embodiment example. This nozzle 20 is shown in its minimum open position in the upper part of FIG. 3 and in its maximum open position in the lower part of FIG. 3 in which the roughly annular or elliptical channel 25 is active. In this case, also, the angle of slope 60 of the conical outer surface area of the nozzle is so selected that it agrees with the angle of slope α' of the outer edges of the free ends 27 of the stator blades (FIG. 1). The inlet 53 is formed by the downstream housing part 52 of the housing 11 which is elliptically shaped. Also, the rotor 14 is driven via ring gears 30 and 31 which are supported in the stators and are alternately drivable by means of intermediate gears and via a distributor gear unit 36 which is constructed as a universal gear as was already described with reference to FIG. 1. Also, a sliding coupling 38 is provided which switches the right or left branch of the distributor gear unit at a vertical shaft drive 39 which is in a drive connection via a drive shaft 40 with a driving motor (not shown) of the watercraft 50 which is shown only schematically. Finally, the entire water jet propulsion unit is swivelable by ±90° around the vertical shaft 39 forming a pivot bearing for the water jet propulsion unit.

In contrast to the embodiment example according to FIGS. 1 and 2, the axes 51 and 52 of the pump 12 and downstream stator are not arranged coaxially, but rather so as to be inclined relative to one another at an angle β. The waterline is indicated in FIG. 3 by reference number 54.

The manner of operation of the water jet propulsion unit described above will be explained in the following.

In the working position of the water jet propulsion unit shown in FIG. 1, the nozzle 21 occupying its maximum open position forms the inlet together with the roughly annular or elliptical channel 26, while the upstream nozzle 20 occupying its minimum open position provides an outlet for the water jet which is accelerated via the rotor 14 and in which turbulence has been eliminated via the stator 16. In this working position—also shown in FIG. 2—the roughly annular or elliptical channel 25 is provided between the wall of the housing 11 and the outer surface area of the nozzle 21. In this switching position of the nozzle, the water jet propulsion unit has the largest outlet opening. The two nozzles can be so adjusted independently of one another via the hydraulic cylinders 23 and 24 which are arranged in pairs that the volume of water entering at the inlet side and exiting at the outlet side can be regulated corresponding to the desired driving conditions. Such regulating devices are known per se and are not described more fully herein for the sake of simplicity and because they do not make up part of the invention. Thus the nozzles 20 and 21 can be displaced by means of the hydraulic cylinders in such a way that the nozzle on the pressure side with the associated stator serves as an outlet nozzle for forward motion and the nozzle on the intake or suction side with associated stator, which now serves as a control device, serves as an inlet, whereas this effect is reversed when the rotating direction of the rotor is reversed simultaneously and the respective supplied water volume can be regulated by means of axial displacement of the respective nozzle on the inlet side.

Thus, switching from forward to reverse travel is effected by independent displacement of the described nozzles while simultaneously changing the rotating direction of the rotor of the pump so that a) the nozzle which previously worked as a nozzle—previous thrust direction—becomes an inlet with an additional outer annular surface, and b) the nozzle which previously worked as an inlet becomes a thrust nozzle with an additional nozzle shaped as an annular channel—new thrust direction.

The stators arranged upstream and downstream of the rotor of the pump accordingly work, as the case may be, as a control device or as a stator and vice versa depending on the thrust direction of the water jet propulsion unit, and the water volume supplied to the rotor with the required pre-rotation can be regulated by changing the axial position of the nozzle in question. When operating as a nozzle, the annular channel which can be changed by displacing the nozzle on the pressure side enables a controlled change in the cross section corresponding to the water volume required for a desired traveling speed.

Similarly, in the embodiment example shown in FIG. 3, the nozzle 20 is displaced axially from the maximum open position to the minimum open position—e.g., likewise by means of hydraulic cylinders—which corresponds to the "full speed ahead" state. For this purpose, the roughly annular or elliptical channel 25 is closed as is shown in the upper part of FIG. 3. When the rotating direction of the rotor is changed, the nozzle 20 with open annular channel 25 is used as an inlet and the inlet 53 is used as an outlet nozzle by means of stator 15 for reverse motion; thus, the functions of the stator and nozzle are reversed as was described above for the embodiment example shown in FIGS. 1 and 2.

For small boats, e.g., so-called pleasure craft, it is advantageous to arrange nozzles 20 and 21 in a rigid fashion and to associate with them a thrust changing slide, not shown, which is supported in the roughly annular or elliptical channels 25 and 26 described above so as to be displaceable back and forth. This thrust changing slide is formed of two bushings which are arranged in a mirror-inverted manner and enclose the nozzles externally and are rigidly connected with one another via rods and which have conical inner surface areas which correspond to the conical outer surface areas of the nozzles, respectively, and to the angles $\alpha$ and $\alpha'$ described above.

When such a thrust changing slide is displaced—instead of the nozzles—motion is switched, e.g., from forward to reverse in the same way as was described for the embodiment examples discussed in the beginning when the rotating direction of the rotor of the pump is changed simultaneously.

While the foregoing description and drawings represent the present invention, it will be obvious to those skilled in the art that various changes may be made therein without departing from the true spirit and scope of the present invention.

What is claimed is:

1. A water jet propulsion unit for a watercraft comprising:

a housing;

a pump which is arranged within said housing, said pump including a rotor and stators with blades;

first and second displaceable nozzles which are supported by said housing and respectively positioned on an inlet side and an outlet side of said pump, said first and second nozzles being provided to generate and change a propulsive water jet whose effective direction can be reversed by changing a rotating direction of said rotor;

hydraulic means for displacing said first and second nozzles in an axial direction, independent from one another, in such a manner that when one of said first and second nozzles is placed in a maximum open position, the remaining nozzle is placed in a minimum open position; and, rotating means for rotating said housing at least ±90° around an axis which is perpendicular to an axis of rotation of said pump;

wherein, said first and second nozzles are arranged coaxially in a mirror-inverted manner, and include a conical outer surface with an angle, as measured relative to said housing, which corresponds to a slope of blades on said stators, and said housing widens in a radial outward direction in a region adjacent to ends of blades on said stators to form an elliptical channel between said nozzles and said housing.

2. The water jet propulsion unit according to claim 1, wherein said rotating means drives the rotor of the pump in a clockwise direction as well as a counterclockwise direction by a distributor gear unit which is constructed as a universal gear and whose gear branches can be activated via a sliding coupling, where a drive shaft of the distributor gear unit forms a swivel axis of the water jet propulsion unit.

3. The water jet propulsion unit according to claim 2, wherein a transmission of power between the distributor gear unit and the rotor is effected by ring gears associated with the stators.

4. The water jet propulsion unit according to claim 1 wherein said water jet propulsion unit is a main propulsion unit for watercraft.

5. The water jet propulsion unit according to claim 1 wherein said water jet propulsion unit is an auxiliary propulsion unit for watercraft.

6. A water jet propulsion unit for a watercraft comprising:

a housing;

a pump which is arranged within said housing at an angle ($\beta$) measured relative to a center axis of said housing, said pump including a rotor and stators with blades;

a displaceable nozzle which is supported by said housing and positioned on one of an inlet side and an outlet side of said pump, said nozzle being provided to generate and change a propulsive water jet whose effective direction can be reversed by changing a rotating direction of said rotor;

hydraulic means for displacing said nozzle in an axial direction between a maximum open position and a minimum open position; and, rotating means for rotating said housing at least ±90° around an axis which is perpendicular to said center axis of said housing;

wherein, said displaceable nozzle functions as one of a controllable inlet and outlet, depending on a rotating direction of said rotor of said pump, and includes a conical outer surface with an angle, as measured relative to said center axis of said housing, which corresponds to a slope of blades on said stators, and said housing widens in a radial outward direction in a region adjacent to ends of blades on said stators to form an elliptical channel between said nozzle and said housing.

* * * * *